United States Patent [19]

Dudzik

[11] Patent Number: 4,887,735

[45] Date of Patent: Dec. 19, 1989

[54] CONTAINER

[75] Inventor: Henryk Dudzik, Mansfield, United Kingdom

[73] Assignee: Mardon Illingworth Ltd., Nottinghamshire, United Kingdom

[21] Appl. No.: 280,688

[22] Filed: Dec. 6, 1988

[51] Int. Cl.[4] ..... B65D 39/00; B65D 43/06

[52] U.S. Cl. ..... 220/307; 220/354; 220/355

[58] Field of Search ..... 220/306, 307, 354, 355, 220/356

[56] References Cited

U.S. PATENT DOCUMENTS

| | | | |
|---|---|---|---|
| 3,378,177 | 4/1968 | Gran . | |
| 3,912,110 | 10/1975 | Hammes | 220/307 |
| 4,046,282 | 9/1977 | Ruch | 220/307 |
| 4,349,119 | 9/1982 | Letica | 220/307 |
| 4,619,373 | 10/1986 | Galer . | |
| 4,667,843 | 5/1987 | Galer . | |

FOREIGN PATENT DOCUMENTS

| | | | |
|---|---|---|---|
| 1175373 | of 1957 | France . | |
| 2023555 | of 1979 | United Kingdom . | |
| 2131775 | 12/1982 | United Kingdom | 220/307 |

*Primary Examiner*—Stephen P. Garbe
*Attorney, Agent, or Firm*—Bachman & LaPointe

[57] ABSTRACT

A container comprising a main container portion (2) having side walls (3) closed at one end and defining an open mouth at the other end, and a moulded rim member (4) having a plug portion (6) slidingly received in the mouth of the main container portion. The plug portion (2) has a projection (8) received in a corresponding groove (30) in the main container portion to retain the rim member in engagement with the main container portion and to provide first sealing means. A flange (22) extends from the plug portion inwardly of the container and terminates at a skirt which provides a seat for a removable plug-fitting lid (40). The rim member (4) includes a tubular portion (18) extending from the plug portion (6) towards the closed end of the main container portion (2), the tubular portion having a maximum outer transverse dimension greater than the inner dimensions of the side walls (3) in the as-mouled state, so that the tubular portion is stressed under compression in its position engaged in the main container portion (2), so that the tubular portion bears against the side walls (3) to provide second sealing means. The flange (22) is joined to the plug portion (6) at a region aligned with the projection (8) and groove (30).

4 Claims, 2 Drawing Sheets

CONTAINER

BACKGROUND OF INVENTION

Figure 1:
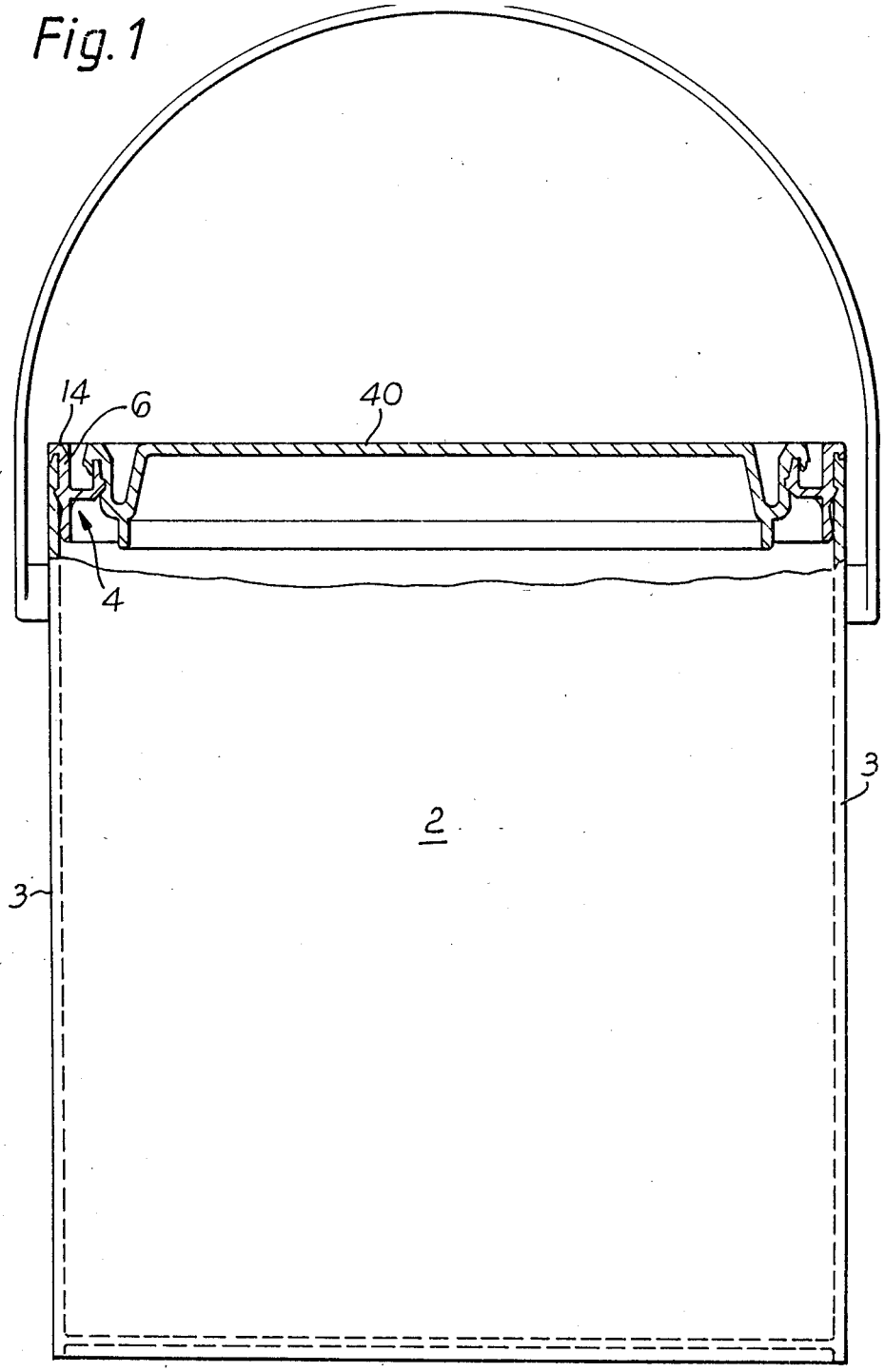

This invention relates to a container especially an injection-moulded container of plastics material.

In many applications, especially storage and supply of emulsion paint, plastics containers are preferred over the previously used sheet metal containers.

Such containers include a rim portion, the container being closed by a push-fitted lid engaged in an opening provided by the rim portion, the container thus provided resembling closely the previously used sheet metal containers.

It has been proposed to mould a main container portion without a rim portion and to secure a separate rim portion at the mouth of the main container portion. Moulding of the main container portion without a rim enables the use of simple injection moulding tools, the main container portion being removed simply by sliding it from a non-collapsible mould core. Such a container having a separately inserted rim portion is described in GB-B-2023555 in which a rim ring is inserted into the mouth of the main container portion and retained in place by engagement of a projection on the rim in a groove on the inner surface of the side walls of the main container portion. However, the construction described in this document is such that, not only is the engagement of the rim ring with the main container portion barely adequate, exhibiting a tendency for the rim ring to slip from the mouth of the container when subjected to force, but also, the seal provided between the rim ring and the mouth of the container portion may be unreliable, permitting leakage of the contents. Furthermore, the construction described in this document does not provide a drip channel, in the rim.

U.S. Pat. No. 4619373 discloses a similar construction to GB-A-2023555, except that the projection is provided on the inner surface of the side walls of the main container portion and the groove is provided in the rim. The projection has to be small to permit removal from a non-collapsible core and the radial faces to the projection make this problem worse. The rim does include a drip channel and the base of the channel is below the groove. A force exerted on the rim through the lid, therefore, tends to separate the groove and the projection, so that leakage is more likely. Similarly an internal force on the lid, caused, for example, by dropping the container would also tend to separate the groove and the projection, so that the rim came apart from the mian container portion.

U.S. Pat. No. 3378177 discloses a container provided with a lid which snaps over the top of the container. There is no separate rim, but the container has an external lip over which the lid engages. The lid also has an internal annular flange which seals with the inner peripheral surface of the container.

U.S. Pat. No. 4667843 discloses a similar structure to US. Pat. No. 4169373, but the projection is provided near the mouth of the main container portion and the drip-channel is connected to the rim by an integral radial web. This radial web is located above the projection and corresponding rim. This construction suffers the same problems as U.S. Pat. No. 4619373.

Figure 2:
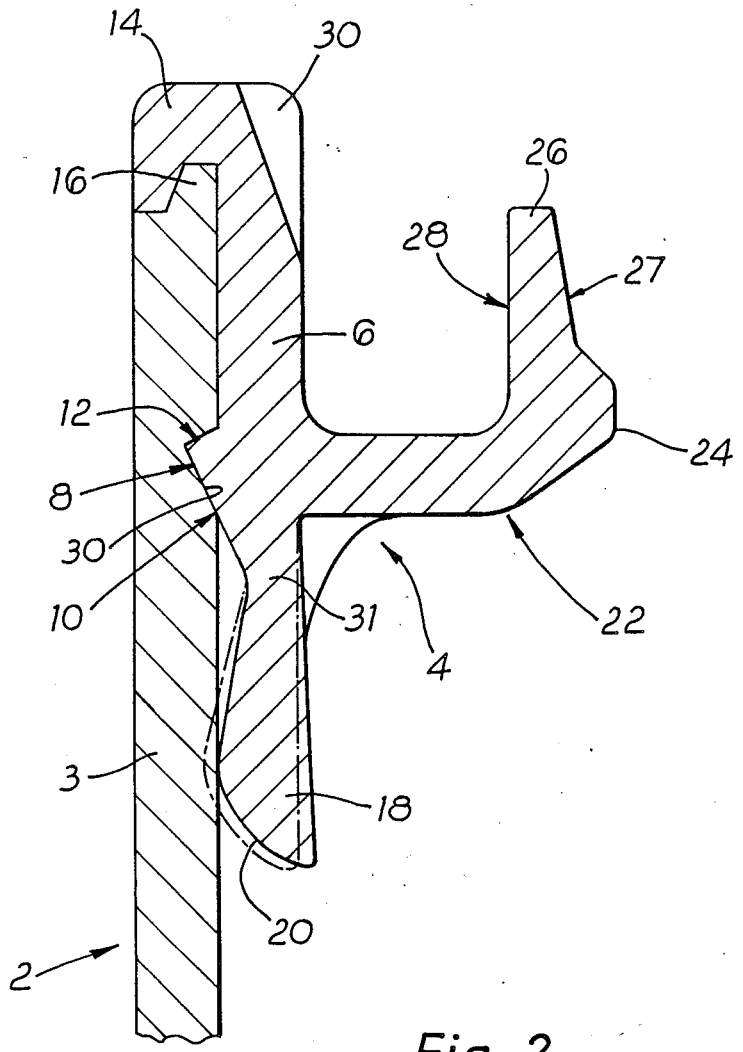

FR-A-1175373 discloses in FIG. 2 a lid which engages a formation at the mouth of a container and an annular tongue which engages a formation within the container to form an internal seal.

SUMMARY OF INVENTION

The present invention provides a container comprising a main container portion having side walls closed at one end and defining an open mouth at the other end, and a moulded rim member having a plug portion slidingly received in the mouth of the main container portion, one of the plug portion and main container portion being provided with a projection received in a corresponding groove in the other portion to retain the rim member in engagement with the main container portion and to provide first sealing means militating against leakage of the contents between the rim member and container portion and a flange extending from the plug portion inwardly of the container and terminating at a skirt which provides a seat for a removable plug-fitting lid, wherein the rim member includes a tubular portion extending from the plug portion towards the closed end of the main container portion, the tubular portion having a maximum outer transverse dimension greater than the inner dimensions of the side walls in the as-moulded state, so that the tubular portion is stressed under compression in its position engaged in the main container portion, whereby the tubular portion bears against the side walls to provide second sealing means militating against leakage of the contents, and wherein the flange is joined to the plug portion at a region aligned with the projection and groove.

There now follows a detailed description, to be read with reference to the accompanying drawing, wherein:

FIG. 1 is a sectional view of a container according to the invention, fitted with a lid; and FIG. 2 is a fragmentary view in section of a mouth portion of the container showing a rim member fitted in a main container portion.

The container comprises a main container portion 2 comprising cylindrical side walls 3 closed at one end and defining an open mouth at the other end, and a rim member 4 comprising a plug portion 6 slidingly received in the mouth of the main container portion 2. Both the main container portion 2 and rim member 4 are injection moulded of a suitable plastics material, the rim member 4 being polypropylene. The main container portion may, if desired, have a different cross-section, for example rectagular or square, the rim member likewise having a corresponding configuration.

About half way along the length of the rim member, the plug portion 6 comprises a projection or collar 8 having leading and trailing faces 10, 12 meeting at a slightly rounded apex, viewing the rim member in cross-section. The leading face 10 flares outwardly to the apex at an acute angle to the longitudinal axis of the container of about 25°. The trailing face tapers inwardly from the apex at an acute angle to the transverse direction (perpendicular to the longitudinal axis) at an angle of about 25°. Normally when the container is placed on a horizontal surface the longitudinal axis is vertical and the transverse direction horizontal.

The collar 8 is arranged to be received in a corresponding groove 30 in the inner surface of the side walls of the main container portion 2 and fits in the groove whereby to retain the rim member 4 in engagement with the main container portion 2. The shape of the collar 8 is such that it facilitates sliding the plug portion 6 into the mouth of the container portion but nevertheless, provides a firm engagement in the groove strongly militating against withdrawal of the collar 8 from the groove. The engagement of the collar 8 in the groove is such as to provide first sealing means militating against leakage of the contents of the container between the rim member 4 and the main container portion 2. An outer end of the plug portion is cylindrical and is in close engagement with the inner surface of the wall of the container portion at the mouth thus further assisting the sealing action.

The plug portion has a flange 14 which engages an upper edge of the main container portion preventing the rim member 4 from being pushed too far into the main container portion 2. On the upper edge of the main container portion is a lip 16 which engages in a corresponding undercut groove in the flange 14 whereby to further strengthen the upper edge portion of the container assembly and to further improve the sealing of the rim member 4 in the main container portion 2.

The rim member 4 further comprises a tubular portion 18 which extends below the collar 8 towards the closed end of the main container portion. The tubular portion 18 meets the leading face 10 of the collar 8 at a region of reduced thickness providing a hinge portion 31 at which the tubular portion 18 can most readily flex relative to the remainder of the rim member 4. The maximum outer diameter of the tubular portion is greater than the inner diameter of the side walls 3.

The tubular portion 18 has an outwardly curved leading edge portion which facilitates its insertion into the mouth of the main container portion 2. As the tubular portion 18 is forced into the mouth of the main container portion 2, it is flexed at the hinge portion 31 and stressed under compression so as to bear against the cylindrical inner surface of the side walls 3. This provides a second sealing means militating against leakage of the contents from the main container portion 2. In FIG. 2, the tubular portion 18 is shown in dash lines in its unstressed, as-moulded state. In the as-moulded state, the inner surface of the tubular portion 18 lies substantially in the longitudinal direction and the outer surface flares outwardly from the hinge portion at an angle of about 15° to the longitudinal direction.

The rim member 4 further comprises an inner flange 22 which projects inwardly from the inner wall of the plug portion 8, and terminates in an annular skirt 26 which extends towards the mouth of the main container portion to define a channel 28 with the inner flange 22 and the plug portion 6.

The annular skirt 26 has an inwardly projecting annular bead 24 which serves as a formation to engage with a lid 40 to retain the lid plug-fitted in the skirt 26. The inner wall 27 of the skirt 26 flares outwardly towards the mouth of the main container portion 2 at an angle of about 10 to the axis of the container portion. The lid comprises an outer wall tapering at the same angle as the wall 27, for engagement with the wall 27 as the lid is inserted in the skirt. The lid has a flange portion projecting outwardly above the skirt 26 so as to overhang the channel 28. In order to facilitate removal of the lid, a plurality of notches 30 (conveniently three) are formed on the inner wall of the plug portion 6 at the mouth end of the container portion so that an instrument, for example the blade of a screwdriver, can be introduced via the notch into the channel 28 beneath the overhanging flange of the lid to prise the lid from the container.

The rim member is a one-piece moulding including the inner flange 22 which joins the plug portion 6 at a position adjacent the collar 8 and in alignment therewith. This alignment provides additional strength in the area of the engagement of the collar 8 in the groove of the container portion and the channel portion 22 assists in resisting deformation of the rim member and the mouth of the container. Furthermore, when the closure member is inserted into the opening in the rim member 4, that too assists in reinforcing the mouth of the container and maintaining the rim member in engagement with the container side walls.

Should the load on the closure member be increased, for example by stacking a number of filled closed containers of the type shown in the drawing one on top of another, the construction and arrangement is such that the sealing means are urged even more firmly against the container portion further improving the seal. The pressure on the inner flange 22 acting around the fulcrum provided by the collar 8 forces the leading edge region of the tubular portion 18 firmly against the side walls of the container portion 2. A similar effect is obtained if internal pressure is increased due to dropping of the container when filled. The use of a channel is customary on paint containers and the like and provides a space for catching drips from the end of the paint brush.

The illustrative container assembly is simple to manufacture, the injection moulding tools required being relatively simple and the provision of first and second sealing means provides improved sealing of the rim against the side walls of the container, whilst the presence of the inner flange 22, positioned as described, gives additional strength to the rim member 4, not only ensuring that the rim member 4 is firmly held in position by engagement of the collar 8 with the groove in the container portion 2 but also providing additional strength in the region of the mouth of the container reducing the likelihood of the container collapsing during stacking and, furthermore, ensuring that the sealing action of the first and second sealing means is improved when a number of full containers are stacked one on top of another.

I claim:

1. A container comprising a main container portion having side walls closed at one end and defining an open mouth at the other end, and a moulded rim member having a plug portion slidingly received in the mouth of the main container portion, one of the plug portion and main container portion being provided with a projection received in a corresponding groove in the other portion to retain the rim member in engagement with the main container portion and to provide first sealing means militating against leakage of the contents between the rim member and container portion and a flange extending from the plug portion inwardly of the container and terminating at a skirt which provides a seat for a removable plug-fitting lid wherein the projection comprises a collar extending around an outer surface of the plug portion and received in a corresponding annular groove in the inner surface of the main container portion wherein the collar has leading and trailing faces meeting at an apex, as viewed in cross-section, the leading face flaring outwardly to the apex at an acute angle to the axis of the container and the trailing face tapering from the apex at an acute angle to the transverse direction, perpendicular to said axis, wherein the rim member includes a tubular portion extending from the plug portion towards the closed end of the main container portion, the tubular portion having a maximum outer transverse dimension greater than the inner dimensions of the side walls in the as-moulded state, so that the tubular portion is stressed under compression in its position engaged in the main container portion, whereby the tubular portion bears against the side walls to provide second sealing means militating against leakage of the contents, and wherein the flange is joined to the plug portion at a region aligned with the projection and groove.

2. A container according to claim 1, wherein a line of weakness between the tubular portion and the plug portion defines a hinge portion about which the tubular portion can flex under stress.

3. A container according to claim 1 wherein the leading face is inclined at an angle of between 20° and 30° to said axis and the trailing face is inclined at an angle of between 20° and 30° to a plane normal to said axis.

4. A container comprising a main container portion having a cylindrical side wall closed at one end and defining an open mouth at the other end, and a moulded rim member having a plug portion slidingly received in the mouth of the main container portion, the plug portion being provided with an annnular projection sealingly received in a corresponding annular groove sealingly in the inner surface of the cylindrical side wall to retain the rim member in engagement with the main container portion, a flange extending from the plug portion inwnardly of the container and terminating at a skirt which provides a seat for a removable plug-fitting lid, and a tubular portion extending from the plug portion towards the closed end of the main container portion and sealingly engaging said inner surface of the cylindrical side wall, wherein the annular projection has leading and trailing faces meeting at an apex, as viewed in cross-section, the leading face flaring outwardly to the apex at a first acute angle to the axis of the main container body and the trailing face tapering from the apex towards said mouth at a second acute angle to said axis, said first angle being smaller than said second angle, and said groove being shaped complementary to said projection.

* * * * *